US009813821B1

(12) United States Patent
Song et al.

(10) Patent No.: US 9,813,821 B1
(45) Date of Patent: Nov. 7, 2017

(54) MINIATURE SOUND GENERATOR

(71) Applicants: Wei Song, Shenzhen (CN); Shuwen Wu, Shenzhen (CN); Yuxin Gu, Shenzhen (CN)

(72) Inventors: Wei Song, Shenzhen (CN); Shuwen Wu, Shenzhen (CN); Yuxin Gu, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/354,584

(22) Filed: Nov. 17, 2016

(30) Foreign Application Priority Data

Jun. 15, 2016 (CN) ..... 2016 2 0581277 U

(51) Int. Cl.
*H04R 9/06* (2006.01)
*H04R 3/00* (2006.01)
*H04R 9/02* (2006.01)

(52) U.S. Cl.
CPC ..... *H04R 9/06* (2013.01); *H04R 3/00* (2013.01); *H04R 9/025* (2013.01)

(58) Field of Classification Search
CPC ... H04R 9/04; H04R 9/06; H04R 3/00; H04R 9/025
See application file for complete search history.

(56) References Cited

U.S. PATENT DOCUMENTS 5,740,264 A * 4/1998 Kojima ..... H04R 9/06 181/171
7,840,025 B2 * 11/2010 Ikeda ..... H04R 9/04 381/403
8,139,815 B2 * 3/2012 Yeom ..... H04R 9/045 381/412
8,794,374 B2 * 8/2014 Kim ..... H04R 7/16 181/164
2011/0200204 A1 * 8/2011 Horigome ..... H04R 9/025 381/86
2013/0156237 A1 * 6/2013 Kim ..... H04R 9/06 381/191
2016/0100254 A1 * 4/2016 Bae ..... H04R 9/043 381/354
2017/0026746 A1 * 1/2017 Reining ..... H04R 1/2873
2017/0164082 A1 * 6/2017 Lee ..... H04R 1/06

FOREIGN PATENT DOCUMENTS

KR 20120016487 A * 2/2012
KR EP 2811759 A1 * 12/2014 ..... H04R 7/04

* cited by examiner

*Primary Examiner* — Brenda Bernardi
(74) *Attorney, Agent, or Firm* — Na Xu; IPro, PLLC

(57) ABSTRACT

A miniature sound generator includes a vibration system including a diaphragm, a voice coil, a damping part supporting the coil elastically, and a fixing system. The voice coil is located below the diaphragm for driving the diaphragm to vibrate and includes a pair of long shaft sides and a pair of short shaft sides. The damping part includes a circuit board arranged on one short shaft side for electrically connecting with the voice coil, and an insulated symmetrical plate arranged on the other short shaft side. The damping part is only arranged at the short shaft sides symmetrically, with one end thereof being fixed with the fixing system, and the other end thereof being fixed with the voice coil. The insulated symmetrical plate has a damping coefficient same to that of the circuit board.

10 Claims, 8 Drawing Sheets

MINIATURE SOUND GENERATOR

FIELD OF THE INVENTION

The invention is related to the technology of electro-acoustic transducers, and especially relates to a miniature sound generator applying a portable mobile electronic product.

DESCRIPTION OF RELATED ART

With development of electronic technology, portable consumer electronic products are increasingly advocated, such as mobile phone, handheld game console, navigation device or multimedia entertainment handset. Such electronic products generally use a miniature sound generator for realizing high-quality music function.

In order to adapt to the miniaturized and multi-functional development of various sound equipment and information communication equipment, a miniature sound generator used in such equipment is required to correspondingly tend to be miniaturization more, so that the miniature sound generator is fit with surrounding other components more compactly. Especially, with the demand of lightening and thinning development of a mobile phone, the quality requirement for the miniature sound generator used is increasingly high.

Under the drive of a magnetic circuit system, a voice coil in the structure of the miniature sound generator in a prior art is swung in the miniature sound generator when vibrating, and the phenomenon of unbalanced vibration is easily presented, thus, causing that the pure tone of the miniature sound generator is poor.

Therefore, it is necessary to provide an improved miniature sound generator to overcome above disadvantage.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENTS

The present invention will hereinafter be described in detail with reference to exemplary embodiment. To make the technical problems to be solved, technical solutions and beneficial effects of present disclosure more apparent, the present disclosure is described in further detail together with the figures and the embodiment. It should be understood the specific embodiment described hereby are only to explain this disclosure, not intended to limit this disclosure.

Figure 1:
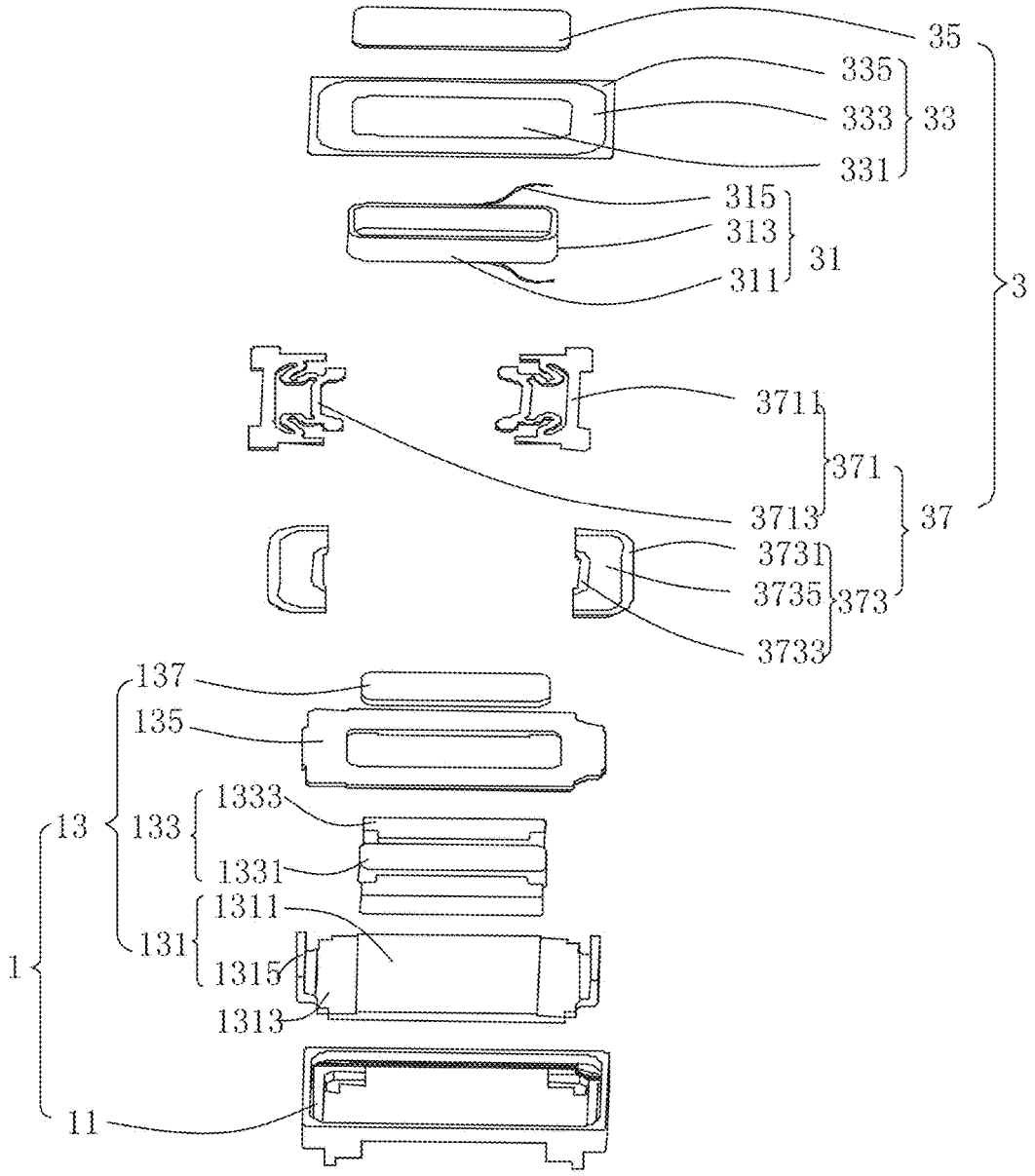
FIG. 1 is an isometric and exploded view of a miniature sound generator in accordance with an exemplary embodiment of the present disclosure.

As shown in FIG. 1, a miniature sound generator 100 in accordance with an exemplary embodiment of the present disclosure comprises a fixing system 1 and a vibration system 3. The fixing system 1 comprises a frame 11 with an accommodation space and a magnetic circuit system 13 accommodated in the frame 11 for driving the vibration system 3.

Figure 2:
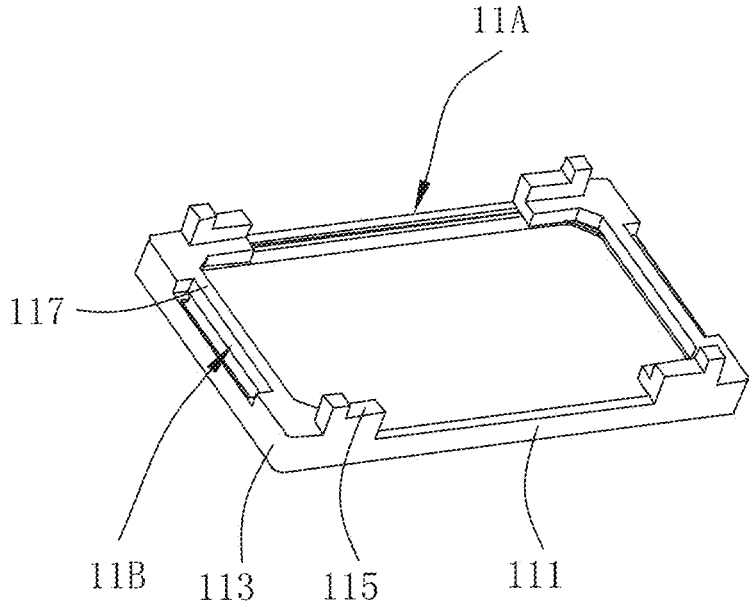
FIG. 2 is an isometric view of a frame of the miniature sound generator in FIG. 1.
Figure 3:
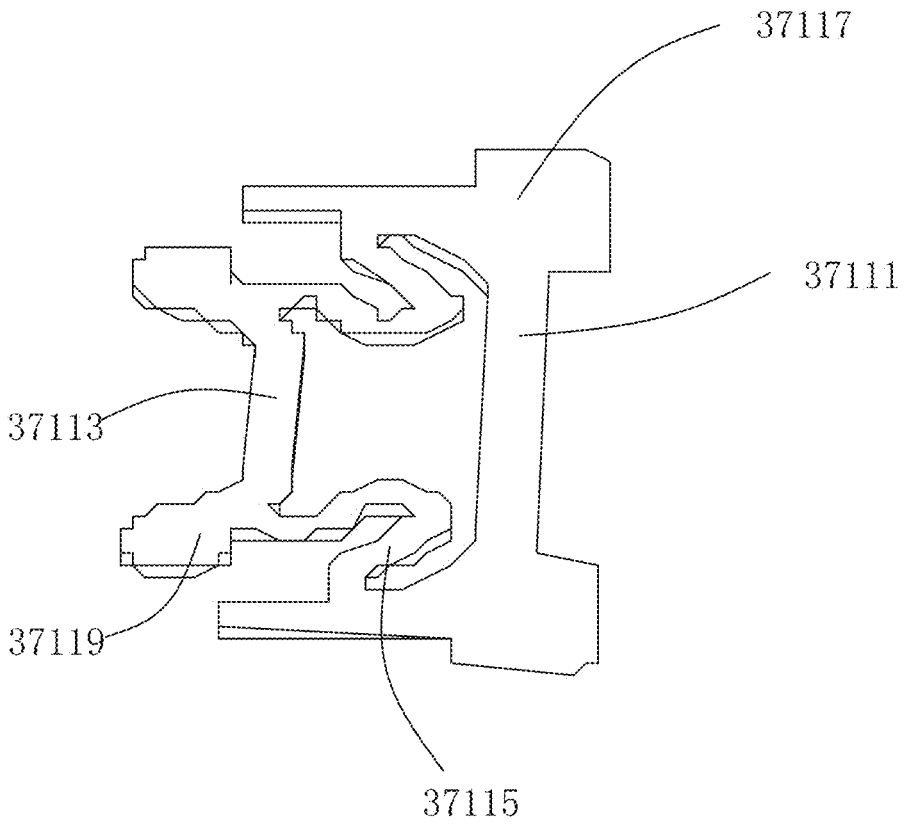
FIG. 3 is an isometric view of a circuit board of the miniature sound generator in FIG. 1.
Figure 4:
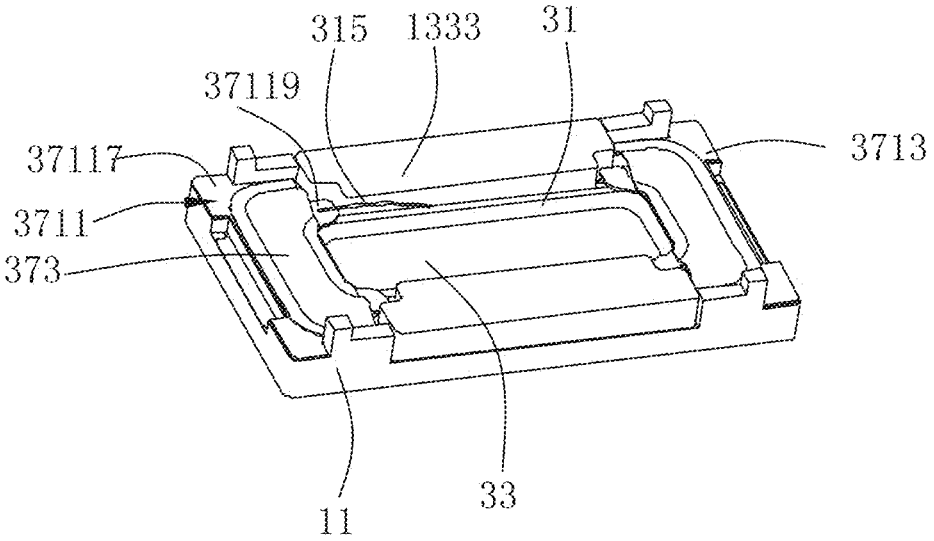
FIG. 4 is an assembled view of a part of the miniature sound generator.
Figure 5:
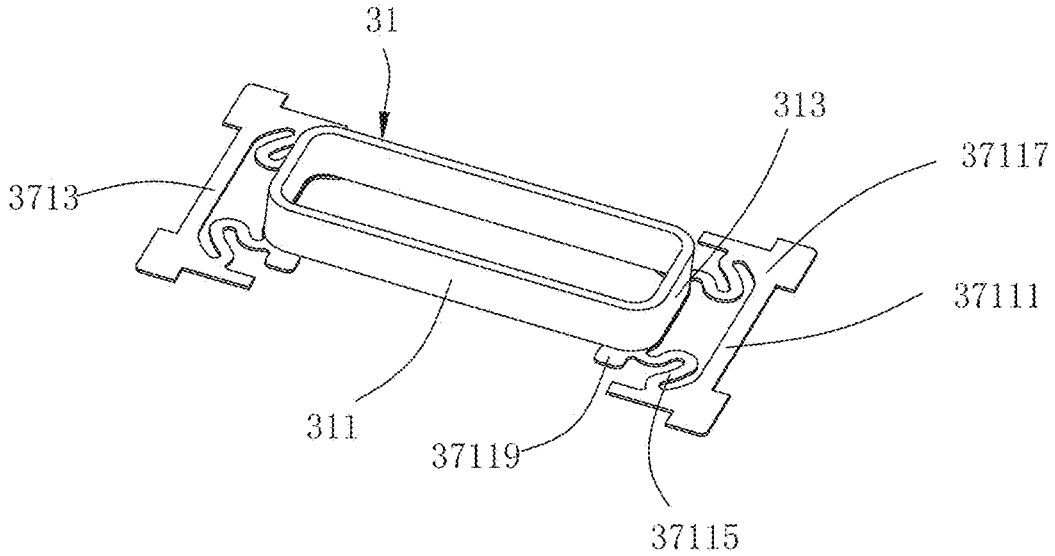
FIG. 5 is an assembled view of another part of the miniature sound generator.
Figure 6:
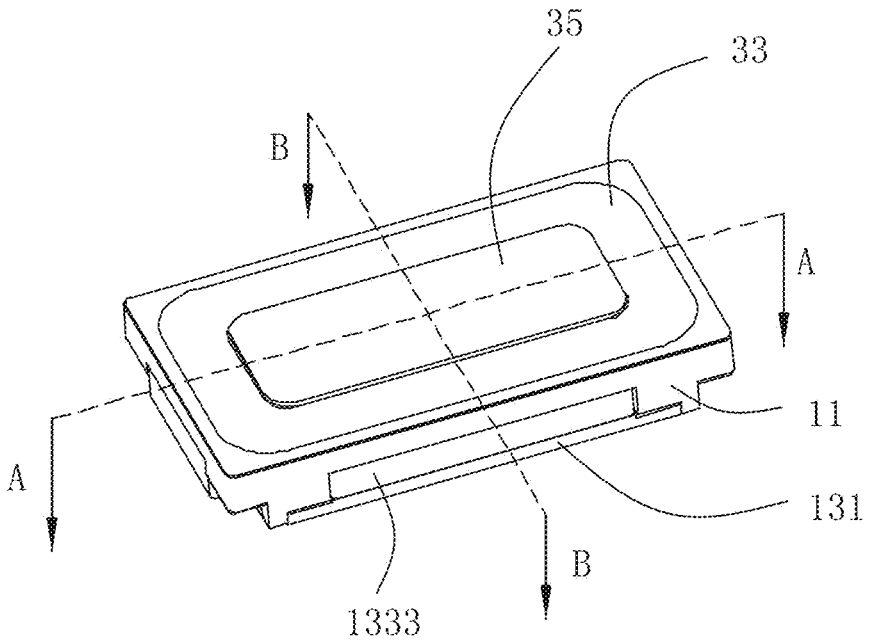
FIG. 6 is an assembled view of the miniature sound generator.
Figure 7:
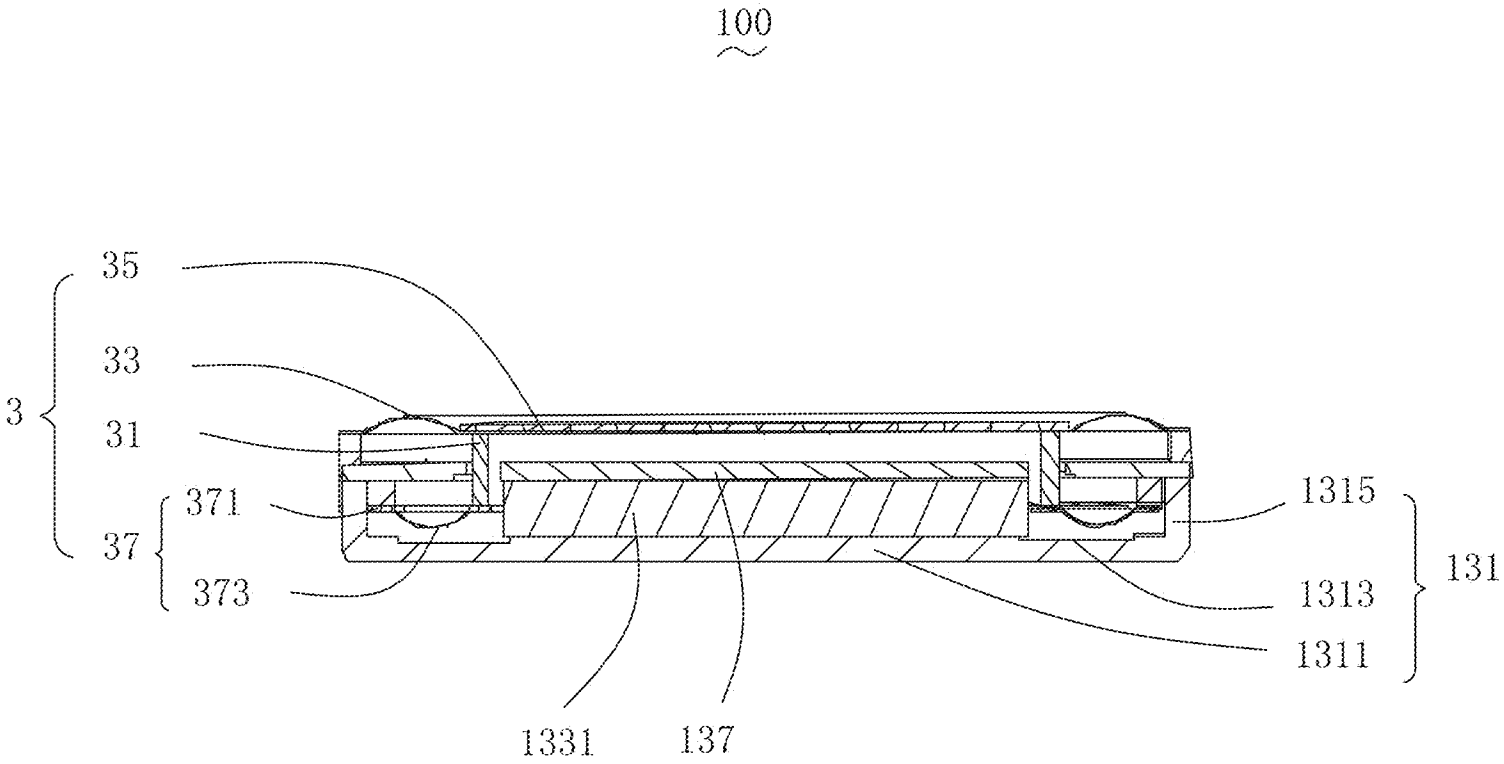
FIG. 7 is across-sectional view of the miniature sound generator taken along line A-A in FIG. 6.
Figure 8:
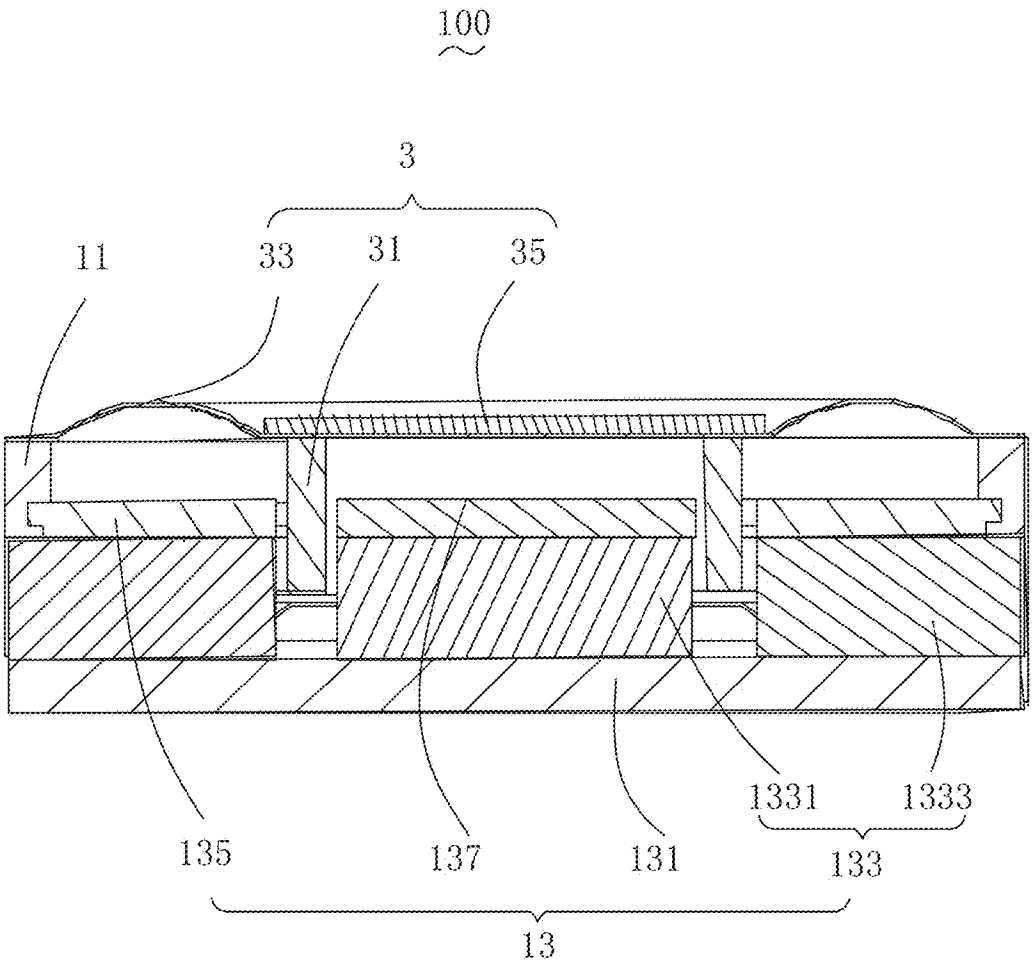
FIG. 8 is across-sectional view of the miniature sound generator taken along line B-B in FIG. 6.

As shown in FIG. 2, the frame 11 comprises two long shaft side walls 111, two short shaft side walls 113, a baffle plate 115 arranged at two ends of the two long shaft side walls 111, and a fixed arm 117 arranged on the short shaft side walls 113. The two long shaft side walls 111 are connected with the two short shaft side walls, a first accommodation part 11A is formed by the baffle plate 115 and the long shaft side walls 111, and a second accommodation part 11B is formed by the fixed arm 117 and the short shaft side walls 113.

The first accommodation part 11A and the second accommodation part 11B are used for at least partially accommodating the magnetic circuit system 13.

As shown in FIGS. 1, 6, 7 and 8, the magnetic circuit system 13 comprises a magnetic bowl 131, a magnet 133, an upper clamping plate 135 and a pole plate 137. The magnetic bowl 131 is fixed on the frame 11, the magnet 133 is disposed on the magnetic bowl 131, the upper clamping plate 135 is fixed on the frame 11 and overlapped on the magnet 133 and is provided with a through hole. The pole plate 137 is located in the through hole of the upper clamping plate 135 and is co-planar with the upper clamping 135.

The magnetic bowl 131 comprises a bottom plate 1311, a avoidance part 1313 formed by deviating from two ends of the bottom plate 1311 toward the opposite direction of the upper clamping plate, and a side plate 1315 formed by bending and extending from the avoidance part 1313 to the direction of the upper clamping plate 135. When the magnetic bowl 131 is fixed on the frame 11, the side plate 1315 is accommodated in the second accommodation part 11B of the frame 11, and the fixed arm 117 is located in the magnetic bowl 131.

The magnet 133 comprises a main magnet 1331 disposed on the bottom plate 1311 and auxiliary magnets 1333, wherein the auxiliary magnets 1333 are arranged at two sides of the main magnet 1331 and forms a magnetic gap with the main magnet 1331. The upper clamping plate 135 is arranged on the auxiliary magnets 1333 in a folding manner, and the pole plate 137 is arranged on the main magnet 1331 in a folding manner.

Two auxiliary magnets 1333 are provided, arranged at two long shaft sides of the main magnet 1331 respectively, and partially accommodated in the first accommodation part 11A of the frame 11. The auxiliary magnets 1333 are partially accommodated in the first accommodation part 11A, thus, helping to increase the volume of the auxiliary magnets 1333, As shown in FIGS. 1, 3-8, the vibration system 3 comprises a voice coil 31, a diaphragm 33, a reinforcing plate 35 and a supporting device 37. One end of the voice coil 31 is inserted into the magnetic gap formed between the main magnet 1331 and the auxiliary magnet 1333, the other end of the voice coil 31 is fixedly connected to the diaphragm 33;

the diaphragm 33 is just opposite to the pole plate 137, and the reinforcing plate 35 is fixedly connected to a surface of the diaphragm 33 far away from the pole plate 137; and the supporting device 37 is used for supporting the voice coil 31 elastically, one end of the supporting device is fixed with the fixing system 1, and the other end of the supporting device is connected with the voice coil 31. The voice coil 31 is vibrated under the effect of a magnetic field of the magnetic circuit system 13 after energizing, and meanwhile, drives the diaphragm 33 to vibrate.

The voice coil 31 is inserted into the magnetic gap. The voice coil 31 comprises a pair of long shaft sides 311, a pair of short shaft sides 313 and a voice coil lead 315 extending outward from the voice coil 31, wherein the long shaft sides 311 are connected with the short shaft sides 313 end to end. The long shaft sides 311 are inserted into the magnetic gap formed between the main magnet 1331 and the auxiliary magnet 1333, the supporting device 37 is elastically supported at the short shaft sides 313, and the voice coil lead 315 is used for connecting the voice coil 31 and an external circuit.

The voice coil 31 further comprises an upper surface fixedly connected to the diaphragm 33, a lower surface opposite to the upper surface and a side surface connecting the upper surface and the lower surface, wherein one end of the supporting device 37 is connected with the lower surface. In other embodiments, one end of the supporting device 37 can also be connected with the side surface.

The diaphragm 33 comprises a dome 331, a suspension 333 extended outward from the dome 331 and a joint part 335 surrounded around the suspension 333. The surface of the dome 331 far away from the pole plate 137 is fixedly connected with the reinforcing plate 35. The surface of the dome 331 opposite to the pole plate 137 is connected with the upper surface of the voice coil 31, and the joint part 335 is connected with the frame 11.

The supporting device 37 comprises a damping part 371 and a vibrating diaphragm 373. The damping part 371 is located below the voice coil 31 and only arranged at the short shaft sides 313 symmetrically, one end of the damping part 371 is fixedly connected with the fixing system 1, and the other end of the damping part 371 is connected with the voice coil 31. On one hand, the damping part 371 plays role of supporting and fixing the voice coil 31, and on the other hand, the damping part 371 is connected with the voice coil lead 315 of the voice coil 31 to play a role of electrically connecting the voice coil 31; and the vibrating diaphragm 373 is connected to the damping part 371. In other embodiments, the supporting device 37 can include the damping part 371 only.

The damping part 371 comprises a circuit board 3711 which is arranged on one said short shaft side 313 and electrically connected with the voice coil 31 and an insulated symmetrical plate 3713 symmetrically arranged on the other said short shaft side 313, wherein the insulated symmetrical plate 3713 has the same damping coefficient with the circuit board 3711.

The circuit board 3711 is a flexible circuit board and comprises a first fixing part 37111 fixed with the fixing system 1, a second fixing part 37113 fixed with the voice coil 31 and an elastic connecting part 37115 connecting the first fixing part 37111 and the second fixing part 37113. The circuit board 3711 further comprises a first bonding pad 37117 formed by extending from the first fixing part 37111 and a second bonding pad 37119 formed by extending from the second fixing part 37113, wherein the first bonding pad 37117 is connected with an external circuit, the electrical connection is realized by the second bonding pad 37119 and the voice coil lead 315 of the voice coil 31 by welding or other ways, a conductive path is arranged on the elastic connecting part 37115 to electrically connect the first bonding pad 37117 and the second bonding pad 37119, and an electric signal of the external circuit is arrived at the second bonding pad 37119 through the first bonding pad 37117 by virtue of the elastic connecting part 37115 and then transmitted to the voice coil 31.

The first fixing part 37111 of the circuit board 3711 is bonded with the fixed arm 117 of the frame 11 by using glue or fixed with the same in a welding manner. In other embodiments, the first fixing part 37111 can also be fixedly connected with the side plate 1315 of the magnetic bowl 131, and the second fixing part 37113 of the circuit board 3711 is supported at the short shaft sides 313 of the voice coil 31.

The insulated symmetrical plate 3713 is symmetrically arranged with the circuit board 3711. In order to guarantee the balance of elastic support of the insulated symmetrical plate 3713 and the circuit board 3711 to the voice coil 31, the insulated symmetrical plate 3713 and the circuit board 3711 have the same structure in shape and have the same damping coefficient, and the insulated symmetrical plate 3713 and the circuit board 3711 have the same mechanical structure by virtue of the same damping coefficient, therefore, the vibration dissipation rate at two sides of the voice coil 31 is equal, and the voice coil 31 can produce the relatively balanced vibration. In the embodiment, the insulated symmetrical plate 3713 can be made of substrate materials of the flexible circuit board, such as polyimide or polyester film substrate, and can also be a nonconductive plate made of other materials. As the circuit board 3711 and the insulated symmetrical plate 3713 support the voice coil 31, therefore, the swinging of the voice coil 31 along the direction of the long shaft can be limited, thereby, improving the pure tone effect of the miniature sound generator 100; and meanwhile, the insulated symmetrical plate 3713 only supports the voice coil 31 elastically, the voice coil lead 315 is only welded with the second bonding pad 37119 of the circuit board 3711, and the insulated symmetrical plate 3713 can be made of substrate materials of the flexible circuit board and can also be a nonconductive plate made of other materials, thus, the process and welding seal lines are not only reduced, but also the usage cost of the circuit board is reduced.

The vibrating diaphragm 373 is made of thin-film materials. Two vibrating diaphragms 373 arranged symmetrically are attached to the surfaces of one side of the circuit board 3711 and insulated symmetrical plate 3713 far away from the diaphragm 33

The vibrating diaphragm 373 comprises a third fixing part 3731, a fourth fixing part 3733 and a connecting part 3735, wherein the fourth fixing part 3733 and the third fixing part 3731 are arranged at intervals, and the connecting part 3735 is used for connecting with the third fixing part 3731 and the fourth fixing part 3733. The third fixing part 3731 and the fourth fixing part 3733 are connected with the circuit board 3711 and the insulated symmetrical plate 3713, the connecting part 3735 is sunken towards the direction of the magnetic bowl 131, and the avoidance part 1313 of the magnetic bowl 131 is corresponding to the connecting part 3735. In other embodiments, the vibrating diaphragm 373 can also be attached to a surface of one side of the circuit board 3711 and the insulated symmetrical plate 3713 close to the diaphragm 33; and at this time, the connecting part 3735 of the vibrating diaphragm 373 is sunken towards the diaphragm 33, therefore, the magnetic bowl 131 cannot be arranged at the avoidance part 1313. The vibrating diaphragm 373 is stuck to the surface of the circuit board 3711 and the insulated symmetrical plate 3713, therefore, the elastic support effect of the supporting device 37 can be further improved, thus, limiting the swinging of the voice coil 31 more effectively. Meanwhile, the voice coil 31 is vibrated under the effect of the magnetic field of the magnetic circuit system 13 after energizing, and then, drives the diaphragm 33 to vibrate, thus, the sounding effect of the miniature sound generator 100 can be further improved.

According to the miniature sound generator 100 provided by the present disclosure, the supporting device 37 is arranged in the direction of the short shaft of the voice coil 31, and elastically supports the voice coil 31, which can limit the swinging of the voice coil 31 along the direction of a long shaft, and meanwhile, the voice coil 31 is fixed by the auxiliary magnet 1333 in the direction of the long shaft, which can limit the swinging of the voice coil 31 in the direction of the long shaft, thus, improving the pure tone effect of the miniature sound generator 100. On the one hand, the circuit board 3711 is a flexible circuit board which elastically supports and is electrically connected with the voice coil 31, and the insulated symmetrical plate 3713 only supports the voice coil 31 elastically, therefore, the voce coil lead 315 is only welded with the second bonding pad 37119 of the circuit board 3711, and an external signal can be transmitted to the voice coil 31 through the circuit board 3711, thus, reducing the process and welding seal lines, and improving the stability of products; and meanwhile, the insulated symmetrical plate 3713 is a nonconductive plate, thus, helping to reduce the usage cost of the circuit board.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A miniature sound generator, comprising:

a vibration system including a diaphragm, a voice coil, and a damping part supporting the coil elastically, the voice coil being located below the diaphragm for driving the diaphragm to vibrate and including a pair of long shaft sides and a pair of short shaft sides; the damping part including a circuit board arranged on one short shaft side for electrically connecting with the voice coil, and an insulated symmetrical plate arranged on the other short shaft side;

a fixing system; wherein the damping part is only arranged at the short shaft sides symmetrically, with one end thereof being fixed with the fixing system, and the other end thereof being fixed with the voice coil; and the insulated symmetrical plate has a damping coefficient same to that of the circuit board.

2. The miniature sound generator as described in claim 1, wherein the circuit board comprises a first fixing part connected with the fixing system, a second fixing part connected with the voice coil, an elastic connecting part for connecting the first fixing part to the second fixing part, a first bonding pad extending from the first fixing part, and a second bonding pad extending from the second fixing part.

3. The miniature sound generator as described in claim 2, wherein the voice coil comprises a voice coil lead, the first bonding pad is connected with an external circuit, and the second bonding pad is connected with the voice coil lead.

4. The miniature sound generator as described in claim 3, wherein the voice coil comprises an upper surface close to the diaphragm, a lower surface away from the diaphragm and a side surface for connecting the upper surface and the lower surface, further, one end of the damping part is connected with the lower surface or the side surface.

5. The miniature sound generator as described in claim 1, wherein the insulated symmetrical plate has a shape same to the circuit board.

6. The miniature sound generator as described in claim 5, wherein the vibration system further comprises two vibrating diaphragms respectively connected to surfaces of the circuit board and the insulated symmetrical plate away from the diaphragm.

7. The miniature sound generator as described in claim 6, wherein the fixing system comprises a magnetic bowl and a magnet carried by the magnetic bowl; each vibrating diaphragm comprises a third fixing part, a fourth fixing part forming a distance from the third fixing part and a connecting part for connecting the third fixing part to the fourth fixing part; the third fixing part and the fourth fixing part are connected with the circuit board and the insulated symmetrical plate, the connecting part is sunken towards the magnetic bowl, and the magnetic bowl comprises an avoidance part corresponding to the connecting part.

8. The miniature sound generator as described in claim 5, wherein the vibration system further comprise two vibrating diaphragms respectively connected to the surfaces of the circuit board and the insulated symmetrical plate close to the diaphragm.

9. The miniature sound generator as described in claim 8, wherein the vibrating diaphragm comprises a third fixing part, a fourth fixing part forming a distance from the third fixing part and a connecting part; the third fixing part and the fourth fixing part are connected with the circuit board and the insulated symmetrical plate, the connecting part is sunken towards the diaphragm.

10. The miniature sound generator as described in claim 1, wherein the circuit board is a flexible circuit board.

* * * * *